US011674362B2

(12) United States Patent
Albeshri et al.

(10) Patent No.: US 11,674,362 B2
(45) Date of Patent: Jun. 13, 2023

(54) SLICKLINE STUFFING BOX SHOCK ABSORBER TOOL

(71) Applicant: SAUDI ARABIAN OIL COMPANY, Dhahran (SA)

(72) Inventors: Raissan F. Albeshri, Khafji (SA); Abbas A. Saho, Saihat (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/484,680

(22) Filed: Sep. 24, 2021

(65) Prior Publication Data

US 2023/0114329 A1 Apr. 13, 2023

(51) Int. Cl.
*E21B 23/14* (2006.01)
*E21B 33/072* (2006.01)
*E21B 17/02* (2006.01)

(52) U.S. Cl.
CPC ..... *E21B 23/14* (2013.01); *E21B 17/023* (2013.01); *E21B 33/072* (2013.01)

(58) Field of Classification Search
CPC ..... E21B 17/023; E21B 33/072; E21B 17/07
See application file for complete search history.

(56) References Cited

U.S. PATENT DOCUMENTS 448,903 A * 3/1891 Yorke ..... E21B 17/05 403/166
966,011 A * 8/1910 Greeves ..... E21B 17/043 403/166
1,121,171 A * 12/1914 Dempsey ..... E21B 4/08 175/325.2
5,549,156 A 8/1996 Borden
10,745,983 B2 * 8/2020 Van Der Hoorn .... E21B 19/008
11,041,344 B1 * 6/2021 Wan ..... E21B 15/02

* cited by examiner

*Primary Examiner* — Jonathan Malikasim
(74) *Attorney, Agent, or Firm* — Osha Bergman Watanabe & Burton LLP

(57) ABSTRACT

A slickline stuffing box shock absorber is disclosed. The slickline stuffing box shock absorber includes a first mechanical component adapted to connect to a slickline in a wellbore, an upper rod rigidly coupled to the first mechanical component, a second mechanical component adapted to connect to a rope socket of a tool string in the wellbore, a lower rod rigidly coupled to the second mechanical component, and a spring adapted to absorb shock energy from the tool string so as to prevent breakage of the slickline, where the upper rod is hollow and has a larger inner diameter than an outer diameter of the lower rod to allow sliding movement of the lower rod inside the upper rod, and where the upper rod and the lower rod are elastically coupled to each other by the spring.

14 Claims, 5 Drawing Sheets

SLICKLINE STUFFING BOX SHOCK ABSORBER TOOL

BACKGROUND

In the oil and gas industry, slickline refers to a braided wire line for suspending a variety of tools into the wellbore, e.g., during well drilling operations or other wellsite operations. With daily operations, there is a risk of slickline cut incidents due to human error or equipment failure. In slickline cut or other equipment failure incidents, the term "fish" refers to unwanted material left in the wellbore, and the term "fishing" refers to the recovery of fish or removal of other obstructions in the wellbore, such as at the bottom of the wellbore. There are numerous negative effects of losing the tools inside the well due to accidental slickline cut, e.g., valuable production loss and lost time for fishing operations could lead to significant cost to the operating company.

SUMMARY

In general, in one aspect, the invention relates to a slickline stuffing box shock absorber. The slickline stuffing box shock absorber includes a first mechanical component adapted to connect to a slickline in a wellbore, an upper rod rigidly coupled to the first mechanical component, a second mechanical component adapted to connect to a rope socket of a tool string in the wellbore, a lower rod rigidly coupled to the second mechanical component, and a spring adapted to absorb shock energy from the tool string so as to prevent breakage of the slickline, wherein the upper rod is hollow and has a larger inner diameter than an outer diameter of the lower rod to allow sliding movement of the lower rod inside the upper rod, wherein respective longitudinal axes of the upper rod and the lower rod are aligned with each other to allow the sliding movement of the upper rod and the lower rod along the aligned longitudinal axes, and wherein the upper rod and the lower rod are elastically coupled to each other by the spring.

In general, in one aspect, the invention relates to a well system. The well system includes a rig, a slickline coupled to the rig through a slickline stuffing box to suspend a tool string in a wellbore, and the stool string including a stem, a rope socket for coupling the stem to a slickline stuffing box shock absorber, and the slickline stuffing box shock absorber having a first mechanical component adapted to connect to the slickline, an upper rod rigidly coupled to the first mechanical component, a second mechanical component adapted to connect to the rope socket, a lower rod rigidly coupled to the second mechanical component, and a spring adapted to absorb shock energy from the tool string so as to prevent breakage of the slickline, wherein the upper rod is hollow and has a larger inner diameter than an outer diameter of the lower rod to allow sliding movement of the lower rod inside the upper rod, wherein respective longitudinal axes of the upper rod and the lower rod are aligned with each other to allow the sliding movement of the upper rod and the lower rod along the aligned longitudinal axes, and wherein the upper rod and the lower rod are elastically coupled to each other by the spring.

In general, in one aspect, the invention relates to a method to perform a well operation. The method includes identifying a type of a tool string to use in a wellbore, selecting, from a plurality of slickline stuffing box shock absorbers, a slickline stuffing box shock absorber based on a type of the tool string, attaching the slickline stuffing box shock absorber to a slickline suspended from a rig, attaching the slickline stuffing box shock absorber to the tool string, controlling a pulling force applied to the slickline to lower the tool string into the wellbore, and in an instance when the tool string encounters a shock and starts an uncontrolled movement toward the bottom of the slickline stuffing box, causing a spring inside the slickline stuffing box shock absorber to compress to reduce a force of impact on the tool string.

Other aspects and advantages will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments of this disclosure provide a slickline stuffing box shock absorber that includes a first mechanical component adapted to connect to a slickline in a wellbore, an upper rod rigidly coupled to the first mechanical component, a second mechanical component adapted to connect to a rope socket of a tool string in the wellbore, a lower rod rigidly coupled to the second mechanical component, and a spring adapted to absorb shock energy from the tool string so as to prevent breakage of the slickline. In particular, the upper rod is hollow and has a larger inner diameter than an outer diameter of the lower rod to allow sliding movement of the lower rod inside the upper rod. In addition, respective longitudinal axes of the upper rod and the lower rod are aligned with each other to allow the sliding movement of the upper rod and the lower rod along the aligned longitudinal axes. Specifically, the sliding movement is facilitated by the spring that elastically couples the upper rod and the lower rod to each other. In one or more embodiments of the invention, the slickline stuffing box shock absorber prevents the loss of tool strings in case of forceful impact in contact with the bottom of stuffing box. The spring-loaded design of the slickline stuffing box shock absorber absorbs the shock on the tool strings preventing the slickline and tool strings from snapping and falling into the well. Specifically, the slickline stuffing box shock absorber converts the kinetic energy produced from the shock into the spring movement action.

Figure 1A:
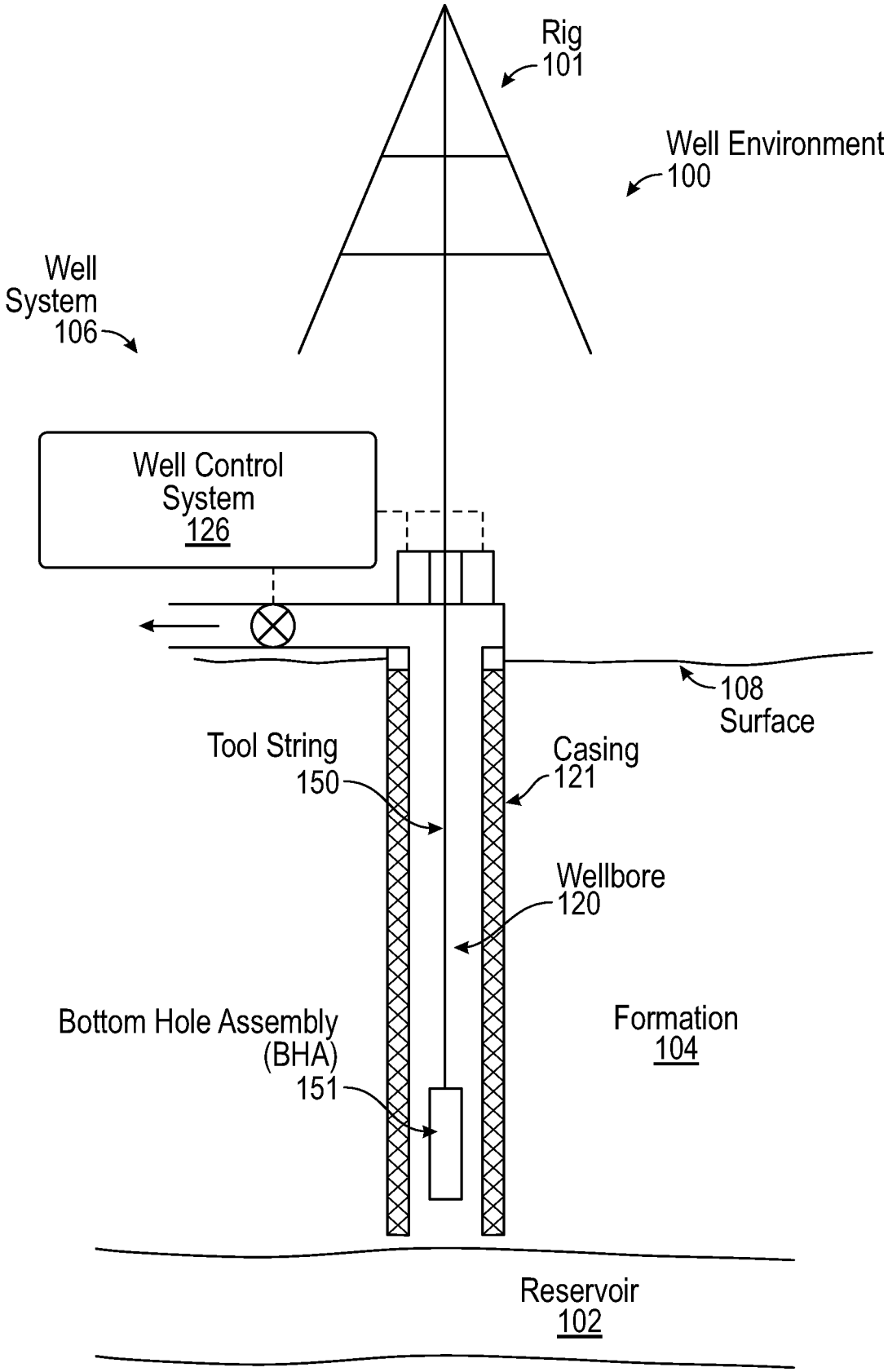
FIG. 1A shows a well system in accordance with one or more embodiments.

FIG. 1A shows a schematic diagram in accordance with one or more embodiments. As shown in FIG. 1A, a well environment (100) includes a subterranean formation ("formation") (104) and a well system (106). The formation (104) may include a porous or fractured rock formation that resides underground, beneath the earth's surface ("surface") (108). The formation (104) may include different layers of rock having varying characteristics, such as varying degrees of permeability, porosity, capillary pressure, and resistivity. In the case of the well system (106) being a hydrocarbon well, the formation (104) may include a hydrocarbon-bearing reservoir (102). In the case of the well system (106) being operated as a production well, the well system (106) may facilitate the extraction of hydrocarbons (or "production") from the reservoir (102).

In some embodiments disclosed herein, the well system (106) includes a rig (101), a wellbore (120) with a casing (121), a tool string (150) suspending a bottom hole assembly (BHA) (151), and a well control system (126). The rig (101) is the machine used to drill a borehole to form the wellbore (120). Major components of the rig (101) include the drilling fluid tanks, the drilling fluid pumps (e.g., rig mixing pumps), the derrick or mast, the draw works, the rotary table or top drive, the tool string, the power generation equipment and auxiliary equipment. Drilling fluid, also referred to as "drilling mud" or simply "mud," is used to facilitate drilling boreholes into the earth, such as drilling oil and natural gas wells. The main functions of drilling fluids include providing hydrostatic pressure to prevent formation fluids from entering into the borehole, keeping the drill bit cool and clean during drilling, carrying out drill cuttings, and suspending the drill cuttings while drilling is paused and when the drilling assembly is brought in and out of the borehole.

The wellbore (120) includes a bored hole (i.e., borehole) that extends from the surface (108) towards a target zone of the formation (104), such as the reservoir (102). An upper end of the wellbore (120), terminating at or near the surface (108), may be referred to as the "up-hole" end of the wellbore (120), and a lower end of the wellbore, terminating in the formation (104), may be referred to as the "downhole" end of the wellbore (120). The wellbore (120) may facilitate the circulation of drilling fluids during drilling operations for the wellbore (120) to extend towards the target zone of the formation (104) (e.g., the reservoir (102)), facilitate the flow of hydrocarbon production (e.g., oil and gas) from the reservoir (102) to the surface (108) during production operations, facilitate the injection of substances (e.g., water) into the hydrocarbon-bearing formation (104) or the reservoir (102) during injection operations, or facilitate the communication of monitoring devices (e.g., logging tools) lowered into the formation (104) or the reservoir (102) during monitoring operations (e.g., during in situ logging operations).

The well control system (126) may control various operations of the well system (106), such as well production operations, well completion operations, well maintenance operations, and reservoir monitoring, assessment and development operations. For example, the well control system (126) may control the aforementioned components of the rig (106), including pulling or lowering of the bottom hole assembly (BHA) (151) during various downhole operations.

In some embodiments, the well system (106) is provided with a bottom hole assembly (BHA) (151) attached to the tool string (150) to suspend into the wellbore (120) for performing various downhole operations, such as the well drilling operation. The bottom hole assembly (BHA) is the lowest part of a tool string and may include the drill bit, drill collar, stabilizer, mud motor, etc.

Example details related to the well system (106) are described in reference to FIG. 1B below.

Figure 1B:
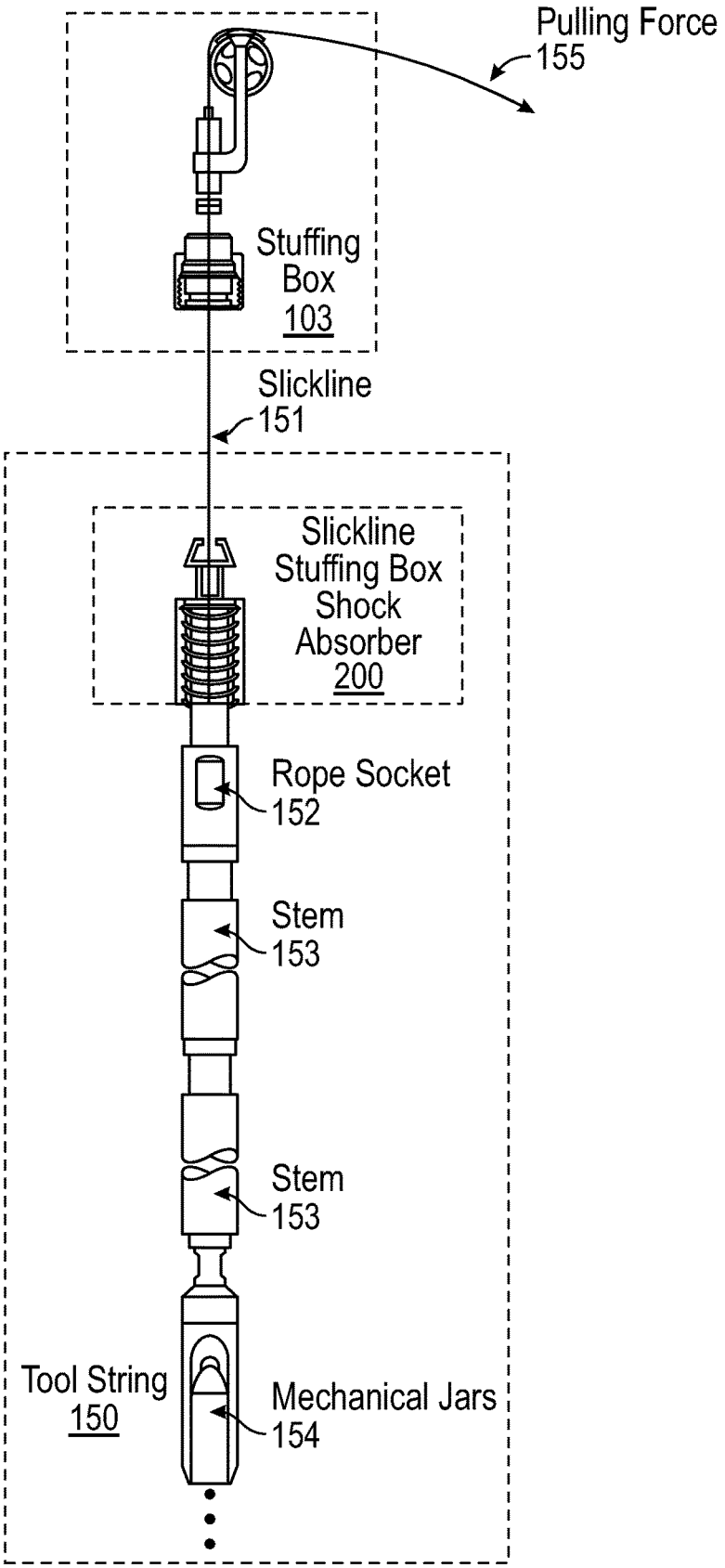
FIG. 1B shows a tool string in accordance with one or more embodiments.

Turning to FIG. 1B, FIG. 1B illustrates a portion of the well system (106) depicted in FIG. 1A above. In one or more embodiments, one or more of the modules and/or elements shown in FIG. 1B may be omitted, repeated, combined and/or substituted. Accordingly, embodiments disclosed herein should not be considered limited to the specific arrangements of modules and/or elements shown in FIG. 1B.

As shown in FIG. 1B, FIG. 1B illustrates details of the tool string (150) that is connected to and suspended from the stuffing box (103) via the slickline (151) and controlled by the pulling force (155). A stuffing box is an assembly used to seal a rotating or reciprocating shaft against fluid leakage, such as water or steam. The stuffing box (103) is at the surface (108) as part of the rig (101) where the pulling force (155) is applied as controlled by the well control system (126). As noted above, the slickline (151) is often used for daily operations with the risk of slickline cut incidents due to human error or equipment failure. In one or more embodiments of the invention, the tool string (150) includes the slickline stuffing box shock absorber (200) to prevent slickline cut incidents. Details of the slickline stuffing box shock absorber (200) are described in reference to FIG. 1C below.

Further as shown in FIG. 1B, the tool string (150) includes the rope socket (152) that is an assembly allowed to twist as the slickline (151) is loaded or pulled. The rope socket (152) used to securely attach slickline to the tool string and minimizes twisting or turning of rest of the tool string (150), such as stems (153), mechanical jars (154), or various swab tools connected below. Including the slickline stuffing box shock absorber (200) between the stuffing box (103) and the rope socket (152) prevents, or otherwise reduces the loss of tool strings and/or cost and time of fishing operations which could lead to a huge production loss from any slickline cut incidents. For example, in case of forceful impact causing the tool string (150) to come into contact with the bottom of stuffing box (103), the slickline stuffing box shock absorber (200) with a spring-loaded design absorbs the shock on the tool string (150) and prevents the slickline (151) and/or tool string (150) from snapping and falling into the wellbore. Specifically, the slickline stuffing box shock absorber (200) converts the kinetic energy produced from the shock into a spring movement action internal to the slickline stuffing box shock absorber (200).

Figure 1C:
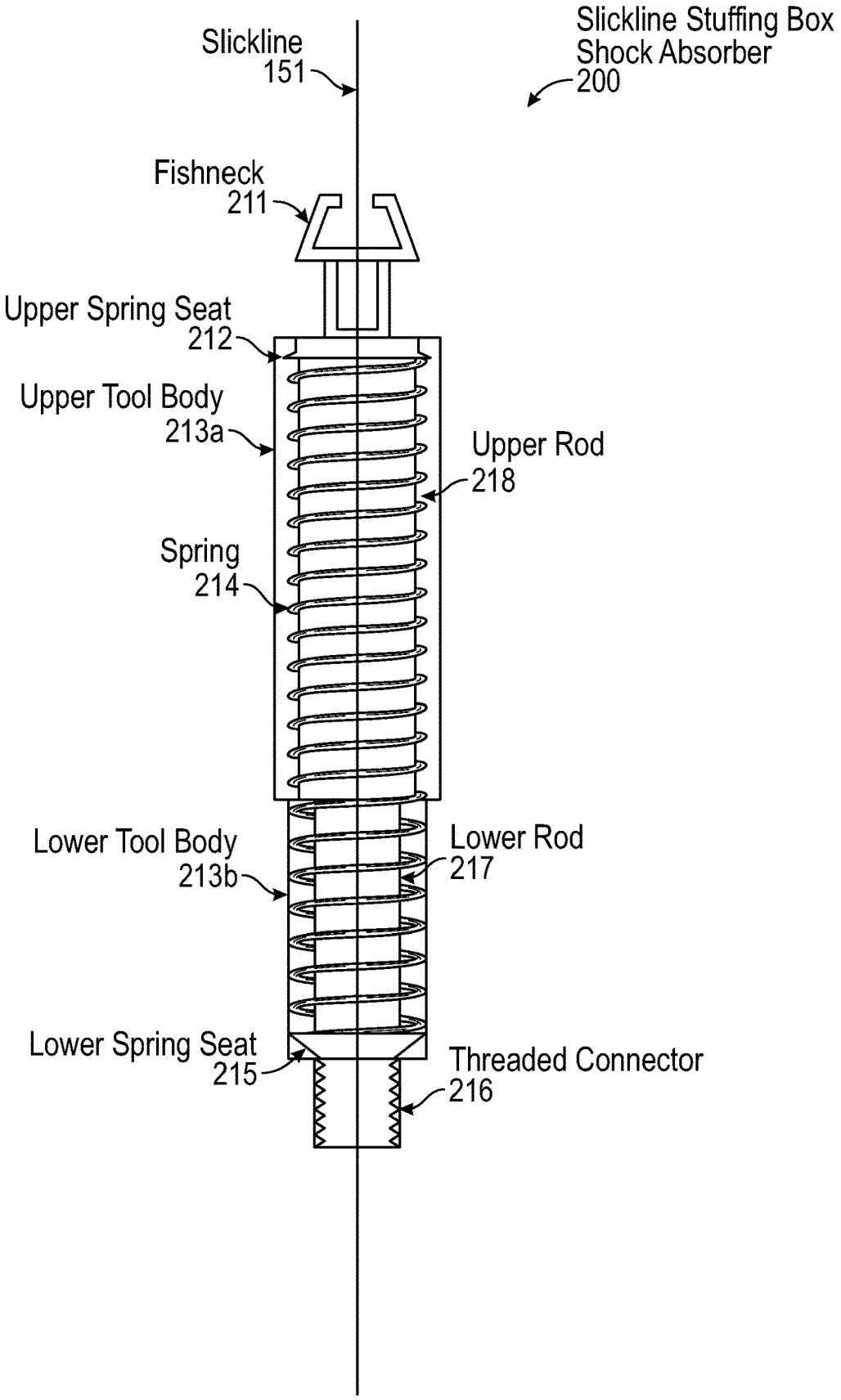
FIGS. 1C and 1D show a shock absorber in accordance with one or more embodiments.

Turning to FIG. 1C, FIG. 1C illustrates details of the slickline stuffing box shock absorber (200) depicted in FIG. 1B above. In one or more embodiments, one or more of the modules and/or elements shown in FIG. 1C may be omitted, repeated, combined and/or substituted. Accordingly, embodiments disclosed herein should not be considered limited to the specific arrangements of modules and/or elements shown in FIG. 1C.

As shown in FIG. 1C, the slickline stuffing box shock absorber (200) includes three sections that are rigidly connected as illustrated below. The first section includes a mechanical component (referred to as a first mechanical component) adapted to connect to a slickline in the wellbore, such as the slickline (151) depicted in FIG. 1B above. In one or more embodiments, the first mechanical component includes a fish neck (211) that allows for quick and easy fishing operation in case of tool string loss. Specifically, the fish neck (211) connects to the slickline (151) and has a surface profile on which a fishing tool may engage to retrieve tubing, tools or equipment that may be stuck or lost in a wellbore.

The second section of the slickline stuffing box shock absorber (200) includes an upper rod (218) and a lower rod (217) individually enclosed inside an upper tool body (213*a*) and a lower tool body (213*b*), respectively. In FIG. 1C, the upper rod (218), lower rod (217), upper tool body (213*a*), and lower tool body (213*b*) are schematically represented as rectangles for clarity such that the spring (214), the upper spring seat (212), and the lower spring seat (25) are visible. The upper rod (218) and/or the upper tool body (213*a*) are rigidly coupled to the first mechanical component, or the fish neck (211). The upper rod (218) is hollow and has a larger inner diameter than the outer diameter of the lower rod (217) to allow sliding movement of the lower rod (217) inside the upper rod (218). Specifically, the longitudinal axes of the upper rod (218) and the lower rod (217) are aligned with each other to allow relative sliding movement of the upper rod (218) and the lower rod (217) along the aligned axes. Similarly, the longitudinal axes of the upper tool body (213*a*) and the lower tool body (213*b*) are aligned with each other to allow relative sliding movement of the upper tool body (213*a*) and the lower tool body (213*b*) along the aligned axes. The upper rod (218) and the lower rod (217) are elastically coupled to each other by the spring (214). Similarly, the upper tool body (213*a*) and the lower tool body (213*b*) are elastically coupled to each other by the spring (214). Specifically, the top (i.e., surface end) of the upper rod (218) and the top (i.e., surface end) of the upper tool body (213*a*) are rigidly coupled to each other and to the spring (214) via the upper spring seat (212). Similarly, the bottom (i.e., downhole end) of the lower rod (217) and the bottom (i.e., downhole end) of the lower tool body (213*b*) are rigidly coupled to each other and to the spring (214) via the lower spring seat (215). In the event when the tool string (150) comes in contact with the bottom of the stuffing box (103), the relative motions between the upper and lower tool bodies and between the upper and lower rods cause, or otherwise allow the spring (214) to compress to reduce the force of impact on the tool string (150).

The third section of the slickline stuffing box shock absorber (200) includes an additional mechanical component (referred to as a second mechanical component) adapted to connect to a rope socket of a tool string in the wellbore. The second mechanical component is rigidly coupled to the lower rod (217) and/or the lower tool body (213*b*). In one or more embodiments, the second mechanical component includes a threaded connector (216) for connecting to the rope socket (152) depicted in FIG. 1B above. Some or all of the components of the slickline stuffing box shock absorber (200) described above a made of stainless steel. In one or more embodiments, the upper tool body (213*a*) and/or the lower tool body (213*b*) are designed to protect the upper rod (218) and/or lower rod (217), respectively, and may be optionally included or omitted from the slickline stuffing box shock absorber (200).

In one or more embodiments, multiple slickline stuffing box shock absorbers are stored or otherwise available within the well system (106). For example, the slickline stuffing box shock absorbers may be installed with different springs that are selected based on different types (e.g., weight) of the tool string used in the wellbore. In particular, the springs may have different maximum tensile strength, elastic constants, and other load bearing specifications. In one or more embodiments, the tool string (150) and the included slickline stuffing box shock absorber (200) perform the functionalities described above using the method described in reference to FIG. 2 below.

Figure 1D:
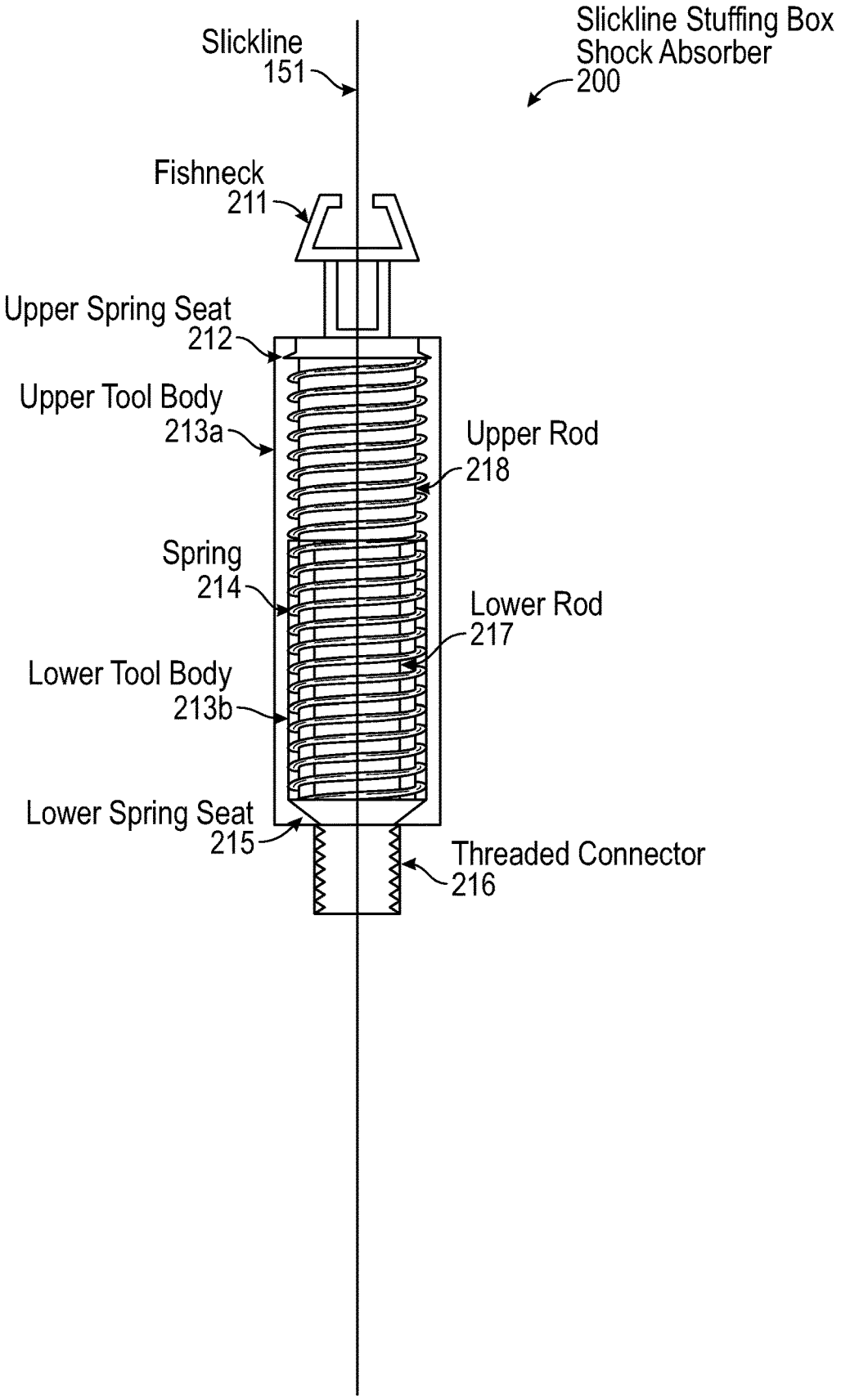

Turning to FIG. 1D, FIG. 1D illustrates a compressed configuration of the slickline stuffing box shock absorber (200) depicted in FIG. 1C above. In one or more embodiments, one or more of the modules and/or elements shown in FIG. 1D may be omitted, repeated, combined and/or substituted. Accordingly, embodiments disclosed herein should not be considered limited to the specific arrangements of modules and/or elements shown in FIG. 1D.

As shown in FIG. 1D, in the compressed configuration of the slickline stuffing box shock absorber (200), the spring 214 is compressed and has a shorter length than what is depicted in FIG. 1C above. Correspondingly, the lower rod (217) is retracted inside the upper rod (218), and the lower tool body (213*b*) is retracted inside the upper tool body (213*a*). In FIG. 1D, the upper rod (218), lower rod (217), upper tool body (213*a*), and lower tool body (213*b*) are schematically represented as rectangles for clarity such that the spring (214), the upper spring seat (212), and the lower spring seat (25) are visible.

Figure 2:
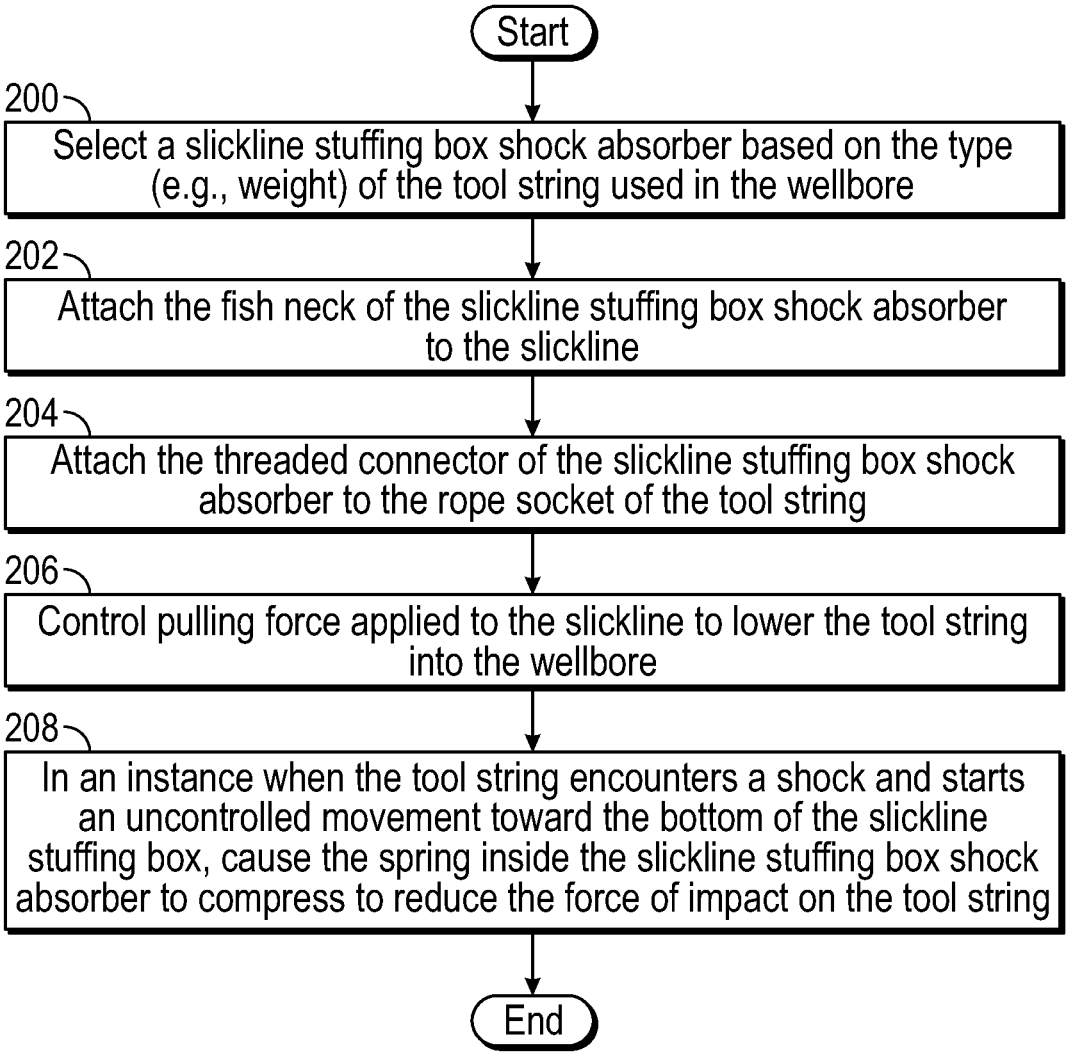
FIG. 2 shows a flowchart in accordance with one or more embodiments.

Turning to FIG. 2, FIG. 2 shows a process flowchart in accordance with one or more embodiments. One or more blocks in FIG. 2 may be performed using one or more components as described in FIGS. 1A-1C. While the various blocks in FIG. 2 are presented and described sequentially, one of ordinary skill in the art will appreciate that some or all of the blocks may be executed in a different order, may be combined or omitted, and some or all of the blocks may be executed in parallel and/or iteratively. Furthermore, the blocks may be performed actively or passively.

Initially in Block 200, a slickline stuffing box shock absorber is selected based on the type (e.g., weight) of the tool string used in the wellbore. For example, the particular slickline stuffing box shock absorber may be selected by matching the maximum tensile strength, elastic constants, and other load bearing specifications of the included spring to the weight or other characteristics of the tool string.

In Block 202, the slickline of the rig goes through the fish neck of the selected slickline stuffing box shock absorber. The fish neck is used to recover the tool in case the tool was left in the wellbore, and the threaded connector of the slickline stuffing box shock absorber is attached to the rope socket of the tool string.

In Block 204, the pulling force applied onto the slickline is controlled to lower the tool string into the wellbore.

In Block 206, in an instance when the tool string encounters a shock and starts an uncontrolled movement toward the bottom of the slickline stuffing box, the spring inside the slickline stuffing box shock absorber is caused to compress to reduce the force of impact on the tool string from the bottom of the slickline stuffing box shock absorber. Specifically, the kinetic energy produced from the shock is converted into a spring movement action internal to the slickline stuffing box shock absorber.

Embodiments of the present disclosure may provide at least one of the following advantages (i) the slickline stuffing box shock absorber is easy to store, transport and set up at the wellsite, (ii) the slickline stuffing box shock absorber can be manufactured using high quality compression springs and other stainless steel material, (iii) the slickline stuffing box shock absorber can be adapted with different size components to suit different applications and requirements, and (iv) the slickline stuffing box shock absorber prevents tool string cut incidents to reduce costly fishing operations and resultant production loss, thus improves well integrity.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A slickline stuffing box shock absorber, comprising:

a first mechanical component adapted to connect to a slickline in a wellbore;

an upper rod rigidly coupled to the first mechanical component;

a second mechanical component adapted to connect to a rope socket of a tool string in the wellbore;

a lower rod rigidly coupled to the second mechanical component;

an upper tool body rigidly coupled to the first mechanical component and adapted to enclose the upper rod; and a lower tool body rigidly coupled to the second mechanical component and adapted to enclose the lower rod; and a spring adapted to absorb shock energy from the tool string so as to prevent breakage of the slickline, wherein the upper rod is hollow and has a larger inner diameter than an outer diameter of the lower rod to allow sliding movement of the lower rod inside the upper rod, wherein respective longitudinal axes of the upper rod and the lower rod are aligned with each other to allow the sliding movement of the upper rod and the lower rod along the aligned longitudinal axes, wherein the upper rod and the lower rod are elastically coupled to each other by the spring, wherein the upper tool body is hollow and has a larger inner diameter than an outer diameter of the lower tool body to allow sliding movement of the lower tool body inside the upper tool body, wherein respective longitudinal axes of the upper tool body and the lower tool body are aligned with each other to allow the sliding movement of the upper tool body and the lower tool body along the aligned longitudinal axes, and wherein the upper tool body and the lower tool body are elastically coupled to each other by the spring.

2. The slickline stuffing box shock absorber of claim 1, further comprising:

an upper spring seat and a lower spring seat disposed at opposite ends of the spring, wherein respective top ends of the upper rod and the upper tool body are rigidly coupled to each other and to the spring via the upper spring seat, and wherein respective bottom ends of the lower rod and the lower tool body are rigidly coupled to each other and to the spring via the lower spring seat.

3. The slickline stuffing box shock absorber of claim 1, wherein the first mechanical component comprises a fish neck.

4. The slickline stuffing box shock absorber of claim 1, wherein the second mechanical component comprises a threaded connector.

5. The slickline stuffing box shock absorber of claim 1, wherein the slickline is coupled to a rig through a slickline stuffing box.

6. The slickline stuffing box shock absorber of claim 5, wherein the shock energy of the tool string is caused by a pulling force applied to the slickline from the rig through the slickline stuffing box.

7. A well system, comprising:

a rig;

a slickline coupled to the rig through a slickline stuffing box to suspend a tool string in a wellbore; and the tool string comprising:

a stem;

a rope socket for coupling the stem to a slickline stuffing box shock absorber; and the slickline stuffing box shock absorber comprising:

a first mechanical component adapted to connect to the slickline;

an upper rod rigidly coupled to the first mechanical component;

a second mechanical component adapted to connect to the rope socket;

a lower rod rigidly coupled to the second mechanical component;

an upper tool body rigidly coupled to the first mechanical component and adapted to enclose the upper rod;

a lower tool body rigidly coupled to the second mechanical component and adapted to enclose the lower rod; and a spring adapted to absorb shock energy from the tool string so as to prevent breakage of the slickline, wherein the upper rod is hollow and has a larger inner diameter than an outer diameter of the lower rod to allow sliding movement of the lower rod inside the upper rod, wherein respective longitudinal axes of the upper rod and the lower rod are aligned with each other to allow the sliding movement of the upper rod and the lower rod along the aligned longitudinal axes, wherein the upper rod and the lower rod are elastically coupled to each other by the spring, wherein the upper tool body is hollow and has a larger inner diameter than an outer diameter of the lower tool body to allow sliding movement of the lower tool body inside the upper tool body, wherein respective longitudinal axes of the upper tool body and the lower tool body are aligned with each other to allow the sliding movement of the upper tool body and the lower tool body along the aligned longitudinal axes, and wherein the upper tool body and the lower tool body are elastically coupled to each other by the spring.

8. The system of claim 7, the slickline stuffing box shock absorber further comprising:

an upper spring seat and a lower spring seat disposed at opposite ends of the spring, wherein respective top ends of the upper rod and the upper tool body are rigidly coupled to each other and to the spring via the upper spring seat, and wherein respective bottom ends of the lower rod and the lower tool body are rigidly coupled to each other and to the spring via the lower spring seat.

9. The system of claim 7, wherein the first mechanical component comprises a fish neck.

10. The system of claim 7, wherein the second mechanical component comprises a threaded connector.

11. The system of claim 7, wherein the shock energy of the tool string is caused by a pulling force applied to the slickline from the rig through the slickline stuffing box.

12. A method to perform a well operation, comprising:

identifying a type of a tool string to use in a wellbore;

selecting, from a plurality of slickline stuffing box shock absorbers, a slickline stuffing box shock absorber based on the type of the tool string;

attaching the slickline stuffing box shock absorber to a slickline suspended from a rig by at least connecting a fish neck of the slickline stuffing box shock absorber to the slickline;

attaching the slickline stuffing box shock absorber to the tool string by at least connecting a threaded connector of the slickline stuffing box shock absorber to a rope socket of the tool string;

controlling a pulling force applied to the slickline to lower the tool string into the wellbore; and in an instance when the tool string encounters a shock and starts an uncontrolled movement toward the bottom of the slickline stuffing box, causing a spring inside the slickline stuffing box shock absorber to compress to reduce a force of impact on the tool string, wherein the slickline stuffing box shock absorber comprises:

the fish neck adapted to connect to the slickline;

the threaded connector adapted to connect to the rope socket;

an upper rod rigidly coupled to the fish neck;

a lower rod rigidly coupled to the threaded connector; and the spring adapted to absorb shock energy from the tool string so as to prevent breakage of the slickline, wherein the upper rod is hollow and has a larger inner diameter than an outer diameter of the lower rod to allow sliding movement of the lower rod inside the upper rod, wherein respective longitudinal axes of the upper rod and the lower rod are aligned with each other to allow the sliding movement of the upper rod and the lower rod along the aligned longitudinal axes, wherein the upper rod and the lower rod are elastically coupled to each other by the spring, wherein the sliding motion of the upper rod and the lower rod causes the spring to compress, wherein the slickline stuffing box shock absorber further comprises:

an upper tool body rigidly coupled to the fish neck and adapted to enclose the upper rod; and a lower tool body rigidly coupled to the threaded connector and adapted to enclose the lower rod, wherein the upper tool body is hollow and has a larger inner diameter than an outer diameter of the lower tool body to allow sliding movement of the lower tool body inside the upper tool body, wherein respective longitudinal axes of the upper tool body and the lower tool body are aligned with each other to allow the sliding movement of the upper tool body and the lower tool body along the aligned longitudinal axes, wherein the upper tool body and the lower tool body are elastically coupled to each other by the spring, and wherein the sliding motion of the upper tool body and the lower tool body further causes the spring to compress.

13. The method of claim 12, further comprising:

storing the plurality of slickline stuffing box shock absorbers at a wellsite where the wellbore is located.

14. The method of claim 12, wherein the slickline stuffing box shock absorber further comprises:

an upper spring seat and a lower spring seat disposed at opposite ends of the spring, wherein respective top ends of the upper rod and the upper tool body are rigidly coupled to each other and to the spring via the upper spring seat, and wherein respective bottom ends of the lower rod and the lower tool body are rigidly coupled to each other and to the spring via the lower spring seat.

* * * * *